United States Patent [19]

Tokitsu et al.

[11] 4,421,480

[45] Dec. 20, 1983

[54] CEILING BEAM CONSTRUCTION FOR HEATING FURNACE

[75] Inventors: Tetsuya Tokitsu, Takarazuka; Saburo Harada, Nara; Jiro Yamasaki; Akihiro Nakama, both of Oita, all of Japan

[73] Assignees: Chugai Ro. Kogyo Co., Ltd., Osaka; Nippon Steel Corp., Tokyo, both of Japan

[21] Appl. No.: 335,276

[22] Filed: Dec. 28, 1981

[51] Int. Cl.[3] ..... F27D 1/12; F23M 5/06; F27B 3/00

[52] U.S. Cl. ..... 432/238; 110/331; 432/174; 432/247

[58] Field of Search ..... 432/11, 126, 144, 150, 432/173, 174, 238, 247; 110/331, 332

[56] References Cited

U.S. PATENT DOCUMENTS

| | | | |
|---|---|---|---|
| 1,105,553 | 9/1914 | Slick | 110/332 |
| 1,275,841 | 8/1918 | Burdon | 432/174 |
| 1,463,241 | 7/1923 | Biglow | 110/332 |
| 2,151,358 | 3/1939 | Robinson | 432/238 |
| 3,022,057 | 2/1962 | Schmidt et al. | 432/150 |
| 3,416,777 | 12/1968 | Alexander, Jr. | 432/126 |

FOREIGN PATENT DOCUMENTS

| | | | |
|---|---|---|---|
| 928244 | 5/1955 | Fed. Rep. of Germany | 432/238 |
| 761814 | 2/1979 | U.S.S.R. | 432/238 |

*Primary Examiner*—John J. Camby

*Attorney, Agent, or Firm*—Wenderoth, Lind & Ponack

[57] ABSTRACT

An improved ceiling beam construction for a heating furnace in which ceiling beams having closed cross sections are adopted for utilizing the interior of the beams as ducts for passing gases through them so as to reduce spaces required for installing separate gas ducts, with a consequent decrease in the number of duct supporting fittings or fixtures.

7 Claims, 4 Drawing Figures

CEILING BEAM CONSTRUCTION FOR HEATING FURNACE

BACKGROUND OF THE INVENTION

The present invention generally relates to a heating furnace for heat treating workpieces such as steel slabs, etc., and more particularly, to a ceiling beam construction for a heating furnace.

Conventionally, in the heating furnace of the above described type, refractory materials for a ceiling of the furnace are generally suspended from ceiling beams constituted by H-shaped steal beams, and provided above the furnace through suspension pipes, hanger tiles, etc. so as to support the weight of such ceiling refractory materials, while combustion air ducts, gas and fuel supply ducts, and exhaust ducts, etc. are normally piped or laid through reinforcing fittings and support fittings fixed to the ceiling beams.

Therefore, in the known ceiling beam constructions, not only is considerable space necessary for the piping of the combustion air ducts, gas and fuel supply ducts and exhaust ducts, but various kinds of fittings and fixtures are required therefor, thus resulting in an increase of the furnace size, with a consequent high cost.

SUMMARY OF THE INVENTION

Accordingly, an essential object of the present invention is to provide an improved ceiling beam construction for a heating furnace in which, by directing particular attention to ceiling beams inevitably employed in the heating furnace, ceiling beams having closed cross sections are adopted for utilizing the interior thereof simultaneously as ducts for passing gases therethrough so as to reduce the space required for installation of separate gas ducts as compared with conventional arrangements, with a consequent decrease in the number of duct supporting fittings or fixtures.

Another important object of the present invention is to provide an improved ceiling beam construction of the above described type which is simple in structure and highly reliable in performance, and can be readily incorporated into heating furnaces of various types at low cost.

In accomplishing these and other objects, according to one preferred embodiment of the present invention, there is provided a ceiling beam construction for a heating furnace which includes a ceiling portion of the heating furnace, and a ceiling beam means for supporting the load of the ceiling portion. The beam means is formed into a closed cross section so as to simultaneously utilize its interior as a gas duct so as to reduce the spaces required for installation of a separate gas duct.

By the arrangement according to the present invention as described above, an improved ceiling beam construction has been advantageously presented, with substantial elimination of disadvantages inherent in the conventional ceiling beam constructions of this kind.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout the several views of the accompanying drawings.

DETAILED DESCRIPTION OF THE INVENTION

Figure 1:
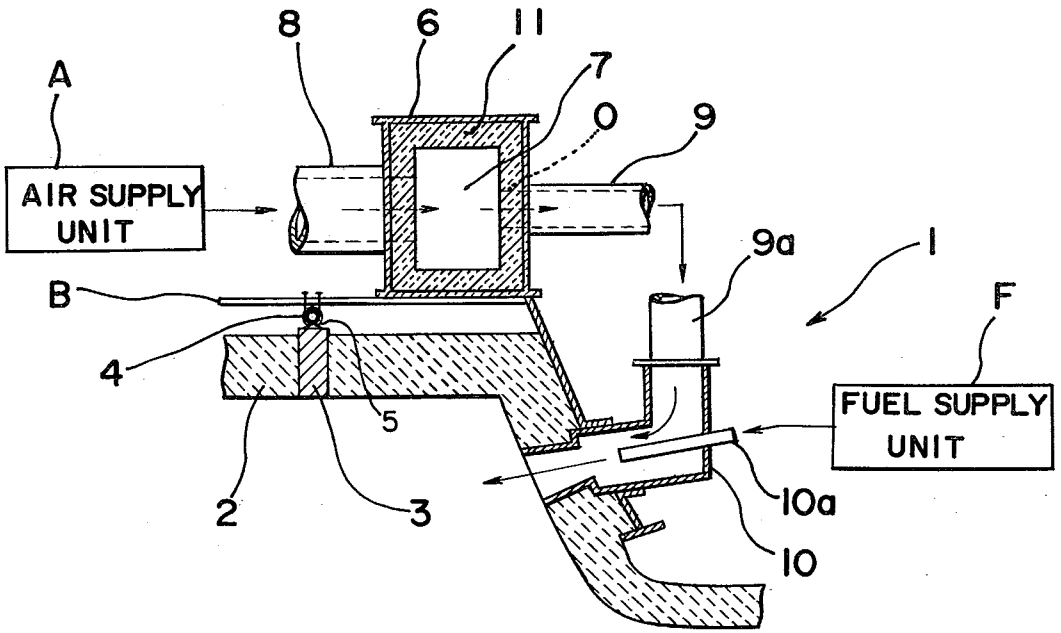
FIG. 1 is a fragmentary side sectional view of a heating furnace in which an improved ceiling beam construction according to the present invention is employed.
Figure 2:
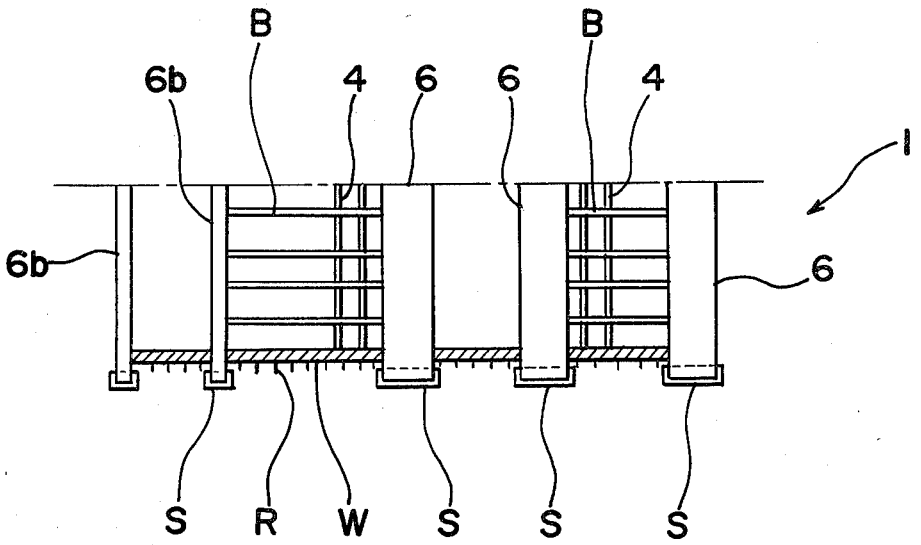
FIG. 2 is a schematic top plan view, partly in section and illustrating only one half side, of a heating furnace to which the ceiling beam construction of FIG. 1 may be applied.
Figure 3:
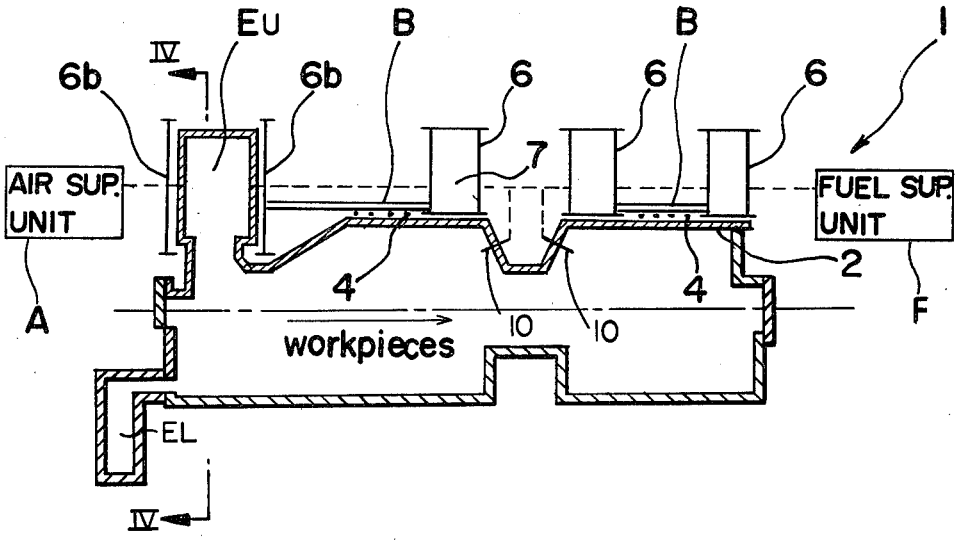
FIG. 3 is a side sectional view of the heating furnace of FIG. 2.

Referring now to the drawings, there is shown, in FIGS. 1 through 3, a ceiling beam construction for a heating furnace 1 according to one preferred embodiment of the present invention. The ceiling beam construction generally includes a plurality of pairs of ceiling beam support posts S (FIG. 2) which are provided adjacent to respective outer faces of opposite side walls W of the heating furnace 1 fixed to studs R at predetermined intervals in the longitudinal direction of side walls W, ceiling beams 6 connected between each pair of said ceiling beam support posts S, a number of auxiliary ceiling beams B provided between said ceiling beams 6 so as to extend in the longitudinal direction of said heating furnace 1, a plurality of ceiling suspension members 4 such as suspension pipes or the like suitably fixed to the auxiliary ceiling beams B so as to extend in the widthwise direction of the heating furnace 1, and hanger tiles 3 (FIG. 1) integrally provided with a ceiling refractory material 2 of the heating furnace 1 and suspended from said suspension members 4, for example, by hanger metals 5.

It should be noted here that the ceiling beam construction described in the foregoing is not particularly essential to the present invention, but may be replaced by any other known constructions of similar type except for the construction of the ceiling beam 6 as described in detail hereinbelow.

Referring particularly to FIG. 1 showing the construction of the ceiling beam directly related to the present invention, the ceiling beams 6 at least in the vicinity of burners 10 arranged in the widthwise direction of the furnace 1 are each formed into a closed cross section of approximately a square configuration for simultaneously utilizing the interior of the ceiling beams 6 as combustion air supply ducts 7.

The combustion air supply duct 7 thus provided in the ceiling beam 6 is connected, at a suitable position, for example, at one side of the beam 6, with a combustion air supply main duct 8 which is further coupled to an air supply unit A, while the ceiling beam 6 is further formed with a plurality of through-holes 0 in position, for example, at its other side, to which a branched pipe 9 having a plurality of air supply ducts 9*a* each connected to the burners 10 is coupled for communication with the air supply duct 7 formed in the ceiling beam 6. For supplying fuel to a nozzle 10*a* of the burner 10, each burner 10 is connected to a fuel supply unit F as shown. Of course depending on the kinds of combustion air to be employed, a suitable heat insulation material 11 may be provided to line the tuner walls of the combustion air supply duct 7, and the closed cross sectional shape of the ceiling beam 6 is not limited to the square shape, but may be modified into various other configurations.

The ceiling beam construction of the present invention may further include an exhaust duct or flue arrangement as shown in FIGS. 2 and 3 for uniform heating of workpieces in a reduced heating time.

More specifically, in the conventional heating furnaces, particularly in an upper and lower combustion type walking beam furnace or the like, it is so arranged that the workpieces to be treated are heated by burners provided at upper and lower portions of the furnace, while exhaust gases produced thereby are discharged into a flue or exhaust duct through one exhaust gas discharge opening provided in the ceiling portion at the workpiece charging side of the heating furnace. Therefore, the flow of combustion exhaust gases within the heating furnace is increased in amount at the upper surface side of the workpieces to be treated, thus resulting in a temperature difference more than necessary between the upper surfaces and lower surfaces of the workpieces, with a consequent increase in the heating time as well as various inconveniences during subsequent processes such as a rolling process, etc.

Figure 4:
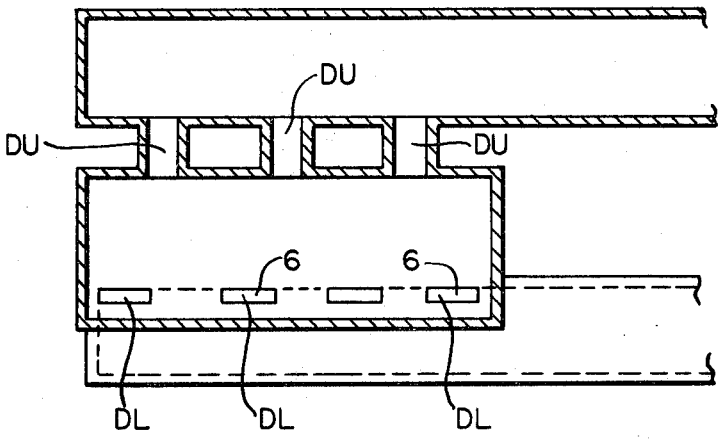
FIG. 4 is a sectional view of the heating furnace taken along lines IV—IV in FIG. 3.

As shown in FIGS. 2, 3 and 4, the exhaust duct arrangement may, for example, include a plurality of discharge openings DU and DL for exhaust gases respectively provided at predetermined intervals in the upper and lower portions of the workpiece charging side (i.e. left side in FIGS. 2 and 3) in the widthwise direction of the heating furnace, and connected to an upper exhaust duct or flue EU disposed between ceiling beams 6*b* at the left side in FIGS. 2 and 3 and also to a lower exhaust duct or flue DL provided at the lower portion of the heating furnace 1, so that the exhaust gases in the heating furnace 1 discharged from the respective discharge openings DU and DL as described above are divided to flow through the upper and lower portions of the heating furnace 1, and exhaust gas flow distribution in the widthwise direction of the upper and lower portions of the furnace 1 is made uniform, for example, by providing dampers (not shown in the Figures) in part or all of the discharge openings according to the locations or dispositions of the openings in the widthwise direction of the furnace 1, while, by providing dampers or a damper either in both or one of the upper exhaust duct EU and the lower exhaust duct EL, the flow ratio of the exhaust gases is adjusted to eliminate the temperature difference in heating in the upper and lower surfaces and longitudinal direction of the workpieces for uniform heating of the workpieces on the whole.

As is clear from the foregoing description, according to the present invention, since it is so arranged that the inner spaces of the ceiling beams themselves are also utilized as gas ducts to be laid at the upper portion of the heating furnace, neither particular spaces for installation of the combustion air supply ducts, exhaust ducts nor various metal fittings such as reinforcing fixtures, etc. for such ducts are required, with a consequent reduction of cost for the heating furnace.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as included therein.

What is claimed is:

1. A ceiling for a heating furnace having side walls extending in widthwise and lengthwise directions comprising:

a ceiling portion for covering the interior of the furnace, ceiling beam means, including a plurality of widthwise extending, lengthwise spaced beams, for vertically supporting said ceiling portion above the side walls of the furnace; said beams having closed cross sections, the interiors of said beams comprising means for transporting gas flow within said furnace so as to reduce the space required in the furnace for separate gas ducts.

2. A ceiling as claimed in claim 1, wherein said beam is formed in a closed cross section of a generally square configuration whose interior serves as a combustion air supply duct for the furnace.

3. A ceiling as claimed in claim 2, further comprising a plurality of branch ducts communicating with said gas duct means, an air supply unit and a combustion air supply main duct communicating with said air supply unit wherein at least one beam is coupled, at one transverse side thereof, with said combustion air supply main duct communicating with said air supply unit, and at its other side, couplable to respective burners of the heating furnace through said plurality of branch ducts communicating with said gas duct means.

4. A ceiling beam construction as claimed in claim 2, wherein the interior of said beam is lined with a heat insulating material.

5. A ceiling for a heating furnace having a workpiece charging side in the widthwise direction thereof having upper and lower portions and having a lower exhaust duct, said ceiling comprising:

a ceiling portion for covering the interior of the furnace, ceiling beam means, including a plurality of widthwise extending, lengthwise spaced beams, for vertically supporting said ceiling portion above the side walls of the furnace; said beams having closed cross sections, the interiors of said beams comprising means for transporting gas flow within said furnace so as to reduce the space required in the furnace for separate gas ducts;

an exhaust duct arrangement including upper exhaust ducts formed in said gas flow transporting means and a plurality of exhaust gas discharge openings respectively provided at predetermined intervals in the upper and lower portions of the workpiece charging side in the widthwise direction of the furnace and communicating with corresponding ones of said upper and lower exhaust ducts.

6. A ceiling as claimed in claim 5, wherein said exhaust gas discharge openings are varied in the cross-sectional area thereof according to their dispositions in the widthwise direction of said heating furnace.

7. A ceiling for a heating furnace having longitudinally extending side walls having outer faces comprising:

a ceiling portion for covering the interior of the furnace, ceiling beam means, including a plurality of widthwise extending, lengthwise spaced beams, for vertically supporting said ceiling portion above the side walls of the furnace; said beams having closed cross sections, the interiors of said beams comprising means for transporting gas flow within said furnace so as to reduce the space required in the furnace for separate gas ducts;

said ceiling further including a plurality of pairs of beam support posts provided adjacent to respective ones of the outer faces of the opposite side walls of the heating furnace at predetermined intervals in the longitudinal direction of said side walls, said ceiling beam means including a corresponding number of ceiling beams connected between each pair of said ceiling beam support posts, a number of auxiliary ceiling beams provided between said ceiling beams so as to extend in the longitudinal direction of the side walls, a plurality of ceiling suspension members fixed to the auxiliary ceiling beams so as to extend in the widthwise direction of the heating furnace, hanger metals, and hanger tiles integrally provided with a refractory material of said ceiling portion of the heating furnace and suspended from said suspension members through said hanger metals.

* * * * *